US008317489B2

(12) United States Patent
Barth

(10) Patent No.: US 8,317,489 B2
(45) Date of Patent: Nov. 27, 2012

(54) REFRIGERANT COMPRESSOR

(75) Inventor: Holger Barth, Lengefeld (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 1072 days.

(21) Appl. No.: 11/435,168

(22) Filed: May 16, 2006

(65) Prior Publication Data

US 2006/0275150 A1 Dec. 7, 2006

(30) Foreign Application Priority Data

May 23, 2005 (DE) ..... 10 2005 024 765
Jun. 20, 2005 (DE) ..... 10 2005 029 760

(51) Int. Cl.
*F04B 39/00* (2006.01)
*F04B 53/00* (2006.01)
*F04B 11/00* (2006.01)

(52) U.S. Cl. ..... 417/312; 417/540; 181/403

(58) Field of Classification Search ..... 417/312, 417/540, 542, 543; 181/403, 275, 229; 62/296
See application file for complete search history.

(56) References Cited

U.S. PATENT DOCUMENTS

| | | | | | |
|---|---|---|---|---|---|
| 3,109,584 | A * | 11/1963 | Gerteis | 417/312 |
| 3,233,822 | A * | 2/1966 | Comstock et al. | 417/29 |
| 3,387,774 | A * | 6/1968 | Gannaway et al. | 417/312 |
| 3,509,907 | A * | 5/1970 | Gannaway | 137/512 |
| 3,663,127 | A * | 5/1972 | Cheers | 417/372 |
| 3,698,840 | A * | 10/1972 | Hover | 417/312 |
| 3,785,453 | A * | 1/1974 | Buonocore et al. | 181/211 |
| 3,864,064 | A * | 2/1975 | Gannaway | 417/312 |
| 3,876,339 | A * | 4/1975 | Gannaway | 417/312 |
| 4,274,813 | A * | 6/1981 | Kishi et al. | 417/269 |
| 5,133,647 | A * | 7/1992 | Herron et al. | 417/312 |
| 5,703,336 | A * | 12/1997 | Tark et al. | 181/179 |
| 6,148,782 | A * | 11/2000 | Fuesser | 123/184.53 |
| 6,824,365 | B2 * | 11/2004 | Park et al. | 417/312 |
| 6,935,848 | B2 * | 8/2005 | Marshal et al. | 417/312 |
| 2001/0050198 | A1 | 12/2001 | An et al. | |
| 2006/0171819 | A1 * | 8/2006 | Fox et al. | 417/312 |

FOREIGN PATENT DOCUMENTS

| | | |
|---|---|---|
| DE | 4118949 | 12/1992 |
| DE | 19912926 | 9/2000 |
| DE | 10011023 | 9/2001 |
| EP | 1 055 818 A2 | 11/2000 |
| GB | 2 365 066 | 2/2002 |

* cited by examiner

*Primary Examiner* — Peter J Bertheaud
(74) *Attorney, Agent, or Firm* — Reinhart Boerner Van Deuren P.C.

(57) ABSTRACT

A refrigerant compressor that includes a compressor housing enclosing an outlet chamber and an outlet passage leading from the outlet chamber to an external high pressure connection, such that the pulsations in it are damped as much as possible. The refrigerant compressor includes a pulsation damping element inserted into the outlet passage of the compressor housing following the outlet chamber. The pulsation damping element has an inlet baffle which faces the outlet chamber and extends over a cross section of the outlet passage and, located opposite to the inlet baffle is an outlet baffle which extends over the cross section of the outlet passage. At least one reflection chamber is provided between the inlet baffle and the outlet baffle. The inlet baffle and the outlet baffle each have at least one passage which faces a reflection surface on the respectively other baffle.

27 Claims, 6 Drawing Sheets

REFRIGERANT COMPRESSOR

This patent application claims the benefit of German applications No. 10 2005 024 765.2, filed May 23, 2005 and No. 10 2005 029 760.9, filed Jun. 20, 2005, the teachings and disclosure of which are hereby incorporated in their entirety by reference thereto.

BACKGROUND OF THE INVENTION

The invention relates to a refrigerant compressor, in particular, a displacement compressor, such as, for example, a piston compressor or scroll compressor, comprising a compressor housing with an outlet chamber enclosed by it and an outlet passage leading from the outlet chamber to an external high pressure connection.

Refrigerant compressors of this type are known from the state of the art. With these refrigerant compressors, particularly when they are piston compressors, pulsations propagate from the outlet chamber and into the adjoining pipe system and these lead, on the one hand, to undesired noises in the pipe system and, on the other hand, to mechanical stressing of the pipe system on account of the pressure peaks.

The object underlying the invention is, therefore, to improve a refrigerant compressor of the generic type in such a manner that the pulsations in it are damped to as great an extent as possible.

SUMMARY OF THE INVENTION

This object is accomplished in accordance with the invention, in a refrigerant compressor of the type described at the outset, in that a pulsation damping element is inserted into the outlet passage of the compressor housing following the outlet chamber, that the pulsation damping element has an inlet baffle which faces the outlet chamber and extends over a cross section of the outlet passage and, located opposite thereto, an outlet baffle which extends over the cross section of the outlet passage, that at least one reflection chamber is provided between the inlet baffle and the outlet baffle and that the inlet baffle and the outlet baffle each have at least one passage which faces a reflection surface on the respectively other baffle.

The advantage of the solution according to the invention is to be seen in the fact that the damping element may be inserted into the outlet passage in the cylinder head and, therefore, requires relatively little space, particularly due to the fact that the damping element has no independent, large damping chamber but rather interacts with the outlet chamber with respect to the volume required for damping.

The damping element according to the invention suppresses any coupling between the outlet chamber acting in a mechanical analogy as a spring for the pulsations and the amount of refrigerant in the pipe system effective as mass in a mechanical analogy and so, as a result, pulsations can be suppressed in an optimum manner.

A particularly favorable solution provides for the damping element to be designed such that stationary waves which extinguish one another at a higher harmonic of a basic frequency of the refrigerant compressor are formed in this damping element. The advantage of this solution is to be seen in the fact that the damping element can be of a space-saving design since it is merely configured such that the stationary waves which extinguish one another and are formed in the element are not of the basic frequency but rather of a higher harmonic of the basic frequency of the refrigerant compressor, wherein this is sufficient for the suppression of the pulsations since the pulsations in the pipe system do not occur with the basic frequency but rather with a higher harmonic of the basic frequency and so it is not necessary to configure the damping element such that stationary waves of the basic frequency which extinguish one another can be formed in the element which would result in the damping element needing to be designed with a very large volume. On the contrary, the configuration of the damping element is sufficient for stationary waves which extinguish one another at a higher harmonic of the basic frequency which should, however, include the higher harmonics of the basic frequency, at which the pulsations primarily occur.

It is even more advantageous when several stationary waves, which extinguish one another and which correspond to different higher harmonics of the basic frequency, are formed in the damping element. This solution therefore allows a so-called "wide-band decoupling" of the pipe system from the outlet chamber due to the provision of stationary waves which extinguish one another at several different harmonics of the basic frequency.

The basic frequency is to be understood in conjunction with the present invention as the frequency which corresponds to the product of the rotational speed of the refrigerant compressor multiplied by the number of discharges of refrigerant per rotation into the respective outlet chamber.

In principle, the passage could be provided as an opening in the inlet baffle and in the respective outlet baffle.

A particularly favorable solution provides, however, for the at least one passage to be formed in each of the baffles as a piece of pipe reaching as far as the reflection chamber.

In this respect, this piece of pipe preferably faces the reflection surface provided on the respectively other baffle.

Such a passage has, in particular, an inner opening, at which a jump in cross section towards the reflection chamber in relation to the passage results, i.e., that each of the at least one passages opens into a reflection chamber between the inlet baffle and the outlet baffle with a jump in cross section.

As a result, the damping effect of the damping element may be optimized in a simple manner.

In this respect, the inner opening is arranged at a distance from the respectively other baffle.

In this respect, the inner opening is preferably located closer to the respectively other baffle than to the baffle having the respective passage.

It is provided, in particular, for the at least one piece of pipe of the one baffle to be arranged so as to overlap with the piece of pipe of the respectively other baffle with an inner end area.

In this respect, the pieces of pipe are preferably connected to one another in the region of the inner end areas.

With respect to the flow cross sections of the passages in the respective baffles, no further details have been given so far. It is particularly advantageous, for example, when the at least one passage in the one baffle has approximately the same flow cross section as the at least one passage in the other baffle.

One particularly advantageous embodiment of a refrigerant compressor according to the invention provides for the inlet baffle to have several passages.

When providing several passages, it would be conceivable, for example, to arrange these as desired in the inlet baffle.

In this respect, it is particularly advantageous when the several passages are arranged around a central axis of the damping element.

A particularly favorable solution from a constructional point of view provides for the several passages to be arranged around the central axis in a rotationally symmetric manner.

In addition, it is likewise advantageous when the outlet baffle has several passages.

It is favorable, in particular, when the several passages of the outlet baffle are arranged around the central axis of the damping element.

It is also particularly expedient with this solution when the several passages of the outlet baffle are arranged around the central axis in a rotationally symmetric manner.

An optimum solution with respect to the flow ratios provides for the sum of the flow cross sections of the at least one passage of the inlet baffle to amount to more than 25% of a flow cross section of the outlet passage.

It is even better when the sum of the flow cross sections of the at least one passage of the inlet baffle amounts to more than 40% of the flow cross sections of the outlet passage.

Furthermore, it is also favorable when the sum of the flow cross sections of the at least one passage of the outlet baffle amounts to more than 25% of the flow cross section of the outlet passage.

It is even better when the sum of the flow cross sections of the several passages of the outlet baffle amounts to more than 40% of the flow cross section of the outlet passage.

Within the scope of the solution according to the invention, it is, however, also conceivable to provide one or several intermediate baffles in addition to the inlet baffle and to the outlet baffle.

In order to be able to position the damping element in an optimum manner with the solution according to the invention, it is preferably provided for the damping element to be fixed in position via an outer mounting element.

It is particularly favorable when one of the baffles is provided with flange areas serving as mounting element and can, therefore, be inserted in the cylinder head at the same time as the mounting flange for the damping element.

Additional features and advantages of the solution according to the invention are the subject matter of the following description as well as the drawings illustrating one embodiment.

DETAILED DESCRIPTION OF THE INVENTION

Figure 1:
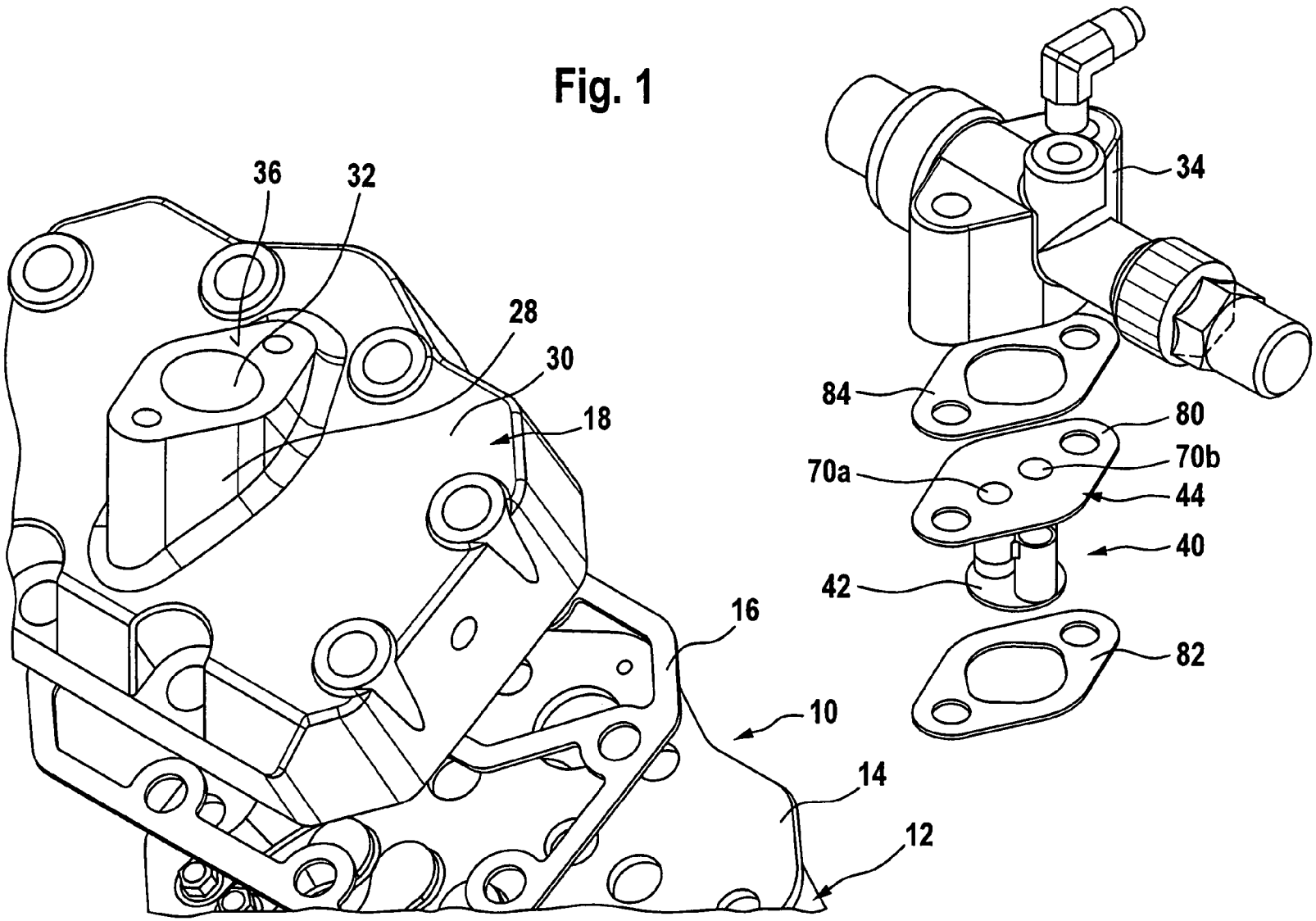
FIG. 1: shows an exploded illustration of part of a compressor housing in the area of a cylinder head.
Figure 2:
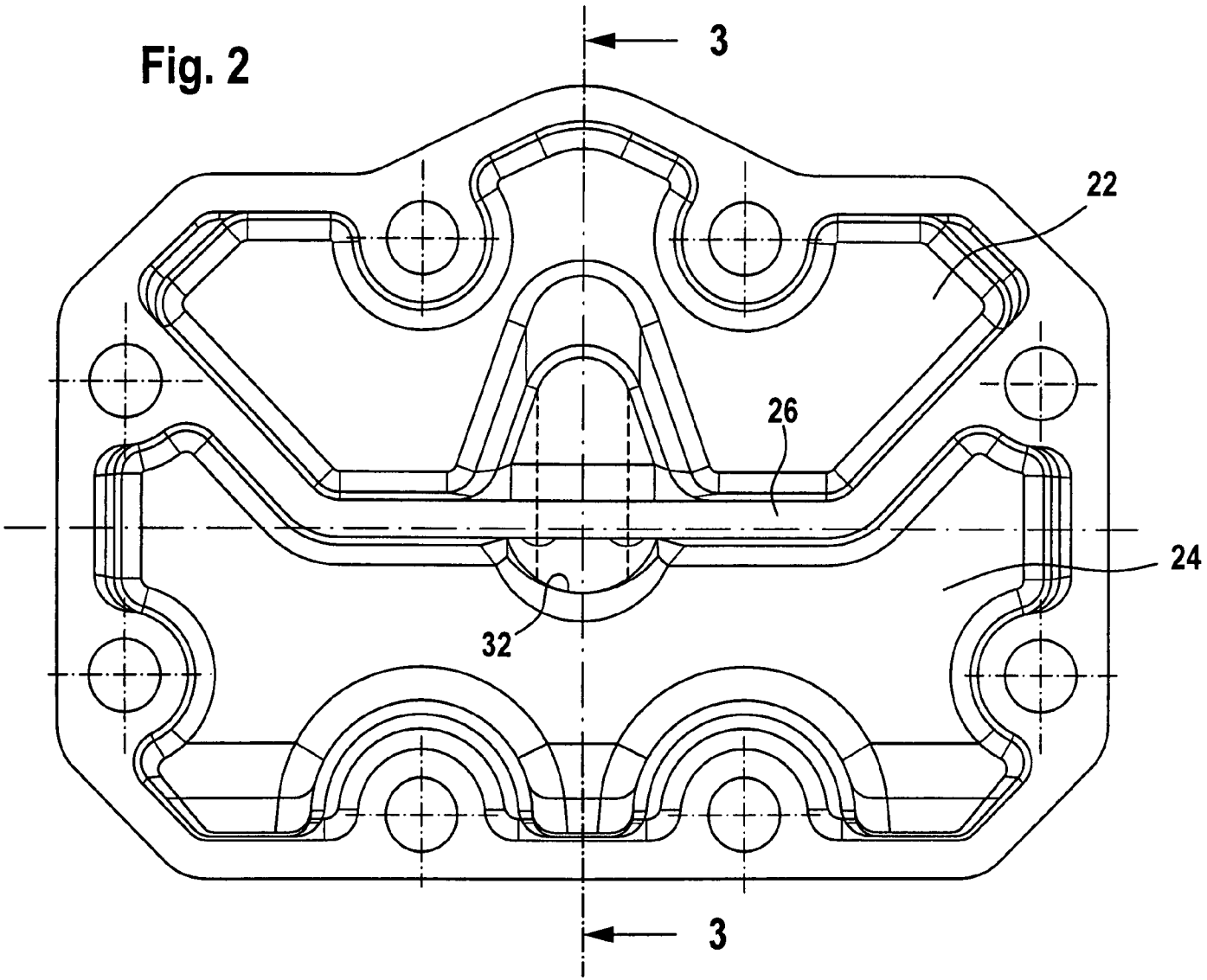
FIG. 2: shows a view of a cylinder head illustrated in FIG. 1 from its underside.
Figure 3:
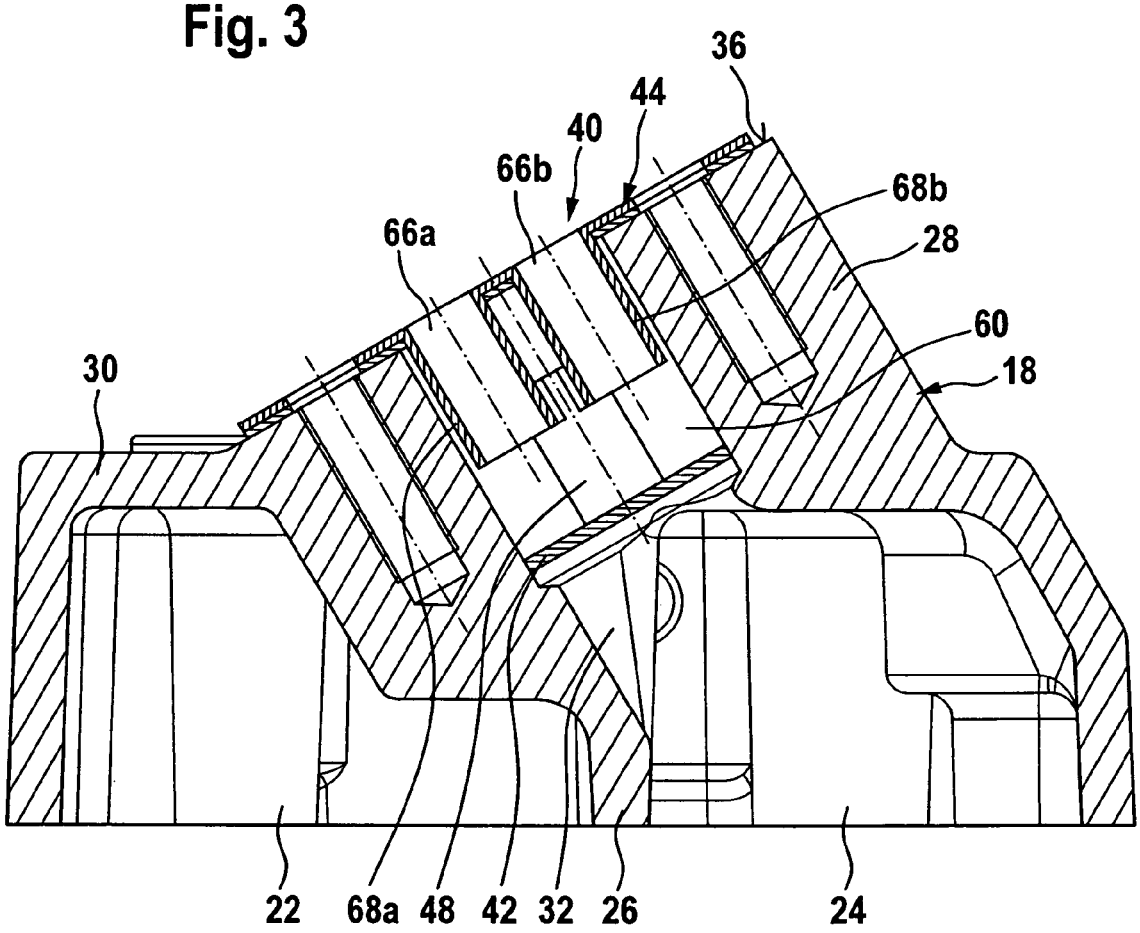
FIG. 3: shows a section along line 3-3 in FIG. 2.

A compressor housing 10 of a displacement compressor designed according to the invention as a piston compressor and partially illustrated in FIG. 1 comprises a cylinder housing 12 with a valve plate 14, on which a cylinder head 18 is arranged which is sealed with a gasket 16 and forms via the valve plate 14 an inlet chamber 22 and an outlet chamber 24 which are separated from one another by a dividing wall 26 in the cylinder head 18.

The cylinder head 18 is, in addition, provided with a short connection pipe 28 which is preferably arranged in a cover 30 of the cylinder head 18 and forms an outlet passage 32, through which the compressed refrigerant can exit from the outlet chamber 24 and enter a pipe connection 34.

The pipe connection 34 can be placed onto a connection surface 36 of the short connection pipe 28 and mounted on it.

In order to dampen pulsations in the flow of refrigerant exiting from the outlet chamber 24, a damping element designated as a whole as 40, which has, as illustrated in FIGS. 1 to 6, an inlet baffle 42 and an outlet baffle 44, is inserted into the connection passage 32 in the short connection pipe 28 which is present in any case.

As a result, the use of the damping element 40 according to the invention does not lead to any increase in the space requirements in the compressor housing 10.

The inlet baffle 42 comprises two passages 46*a* and 46*b* which are formed by pieces of pipe 48*a* and 48*b* which extend over a distance RE from entry openings 52*a* and 52*b* facing the outlet chamber 24 as far as first, inner openings 54*a* and 54*b* facing the outlet baffle 44.

The two passages 46*a* and 46*b* are preferably arranged so as to be symmetric to a central axis 56 of the damping element 40. Furthermore, the first, inner openings 54*a* and 54*b* are located at a distance AE from the outlet baffle 44 and each face a closed reflection surface 58*a* and 58*b* of the outlet baffle 44 formed by the outlet baffle 44 so that pulsation vibrations passing through the passages 46*a* and 46*b* first enter a chamber 50*a*, 50*b*, which is limited by the outlet passage 32 and the outlet baffle 44, with a jump in cross section at the first, inner openings 54*a*, 54*b* and then experience a reflection at the reflection surfaces 58*a* and 58*b* of the outlet baffle 44 and are thereby partially reflected back again through the passages 46*a* and 46*b* or are reflected into a chamber 60*a*, 60*b* which is located outside the pieces of pipe 48*a*, 48*b* and surrounds them and which is limited, on the one hand, by the outlet passage 32 of the short connection pipe 28 and, on the other hand, by the pieces of pipe 48*a* and 48*b* and by the inlet baffle 42 towards the outlet chamber 24, namely by reflection surfaces 62*a* and 62*b* of the inlet baffle 42. The reflection surfaces 58*a*, 58*b* and the reflection surfaces 62*a*, 62*b* have a distance BE from one another which is somewhat larger than RE plus AE.

Second, inner openings 64*a* and 64*b* of passages 66*a* and 66*b* arranged at a distance M from these reflection surfaces 62*a* and 62*b* are again associated with these reflection surfaces, located opposite them, so that a jump in cross section between the second, inner openings 64*a*, 64*b* and the reflection chambers 60*a*, 60*b* in relation to the passages 66*a*, 66*b* results, wherein the passages 66*a* and 66*b* are formed on the side of the outlet baffle 44, namely by pieces of pipe 68*a* and 68*b* which extend from the outlet baffle 44 to the second, inner openings 64*a* and 64*b* and thereby proceed from outlet openings 70*a* and 70*b* in the outlet baffle 44 which are arranged at a distance RA from the inner openings 64*a*, 64*b*, wherein the outlet openings 70*a* and 70*b* face the pipe connection 34 and so the compressed refrigerant exiting from them can flow away via the pipe connection 34.

The passages 66*a* and 66*b* are also arranged symmetrically to the central axis 56 but offset through 90° in relation to the passages 46*a*, 46*b*.

Furthermore, the second, inner openings 64 are arranged at a distance AA from the inlet baffle 42.

In the case of the embodiment described, the distances AE between the inner openings 54*a* and 54*b* as well as the reflection surfaces 58*a* and 58*b* as well as the distances AA between the inner openings 64*a* and 64*b* and the reflection surfaces 62*a* and 62*b* are less than the lengths of the pieces of pipe 48*a* and 48*b* as well as 68*a* and 68*b* and so the pieces of pipe 48*a* and 48*b* overlap one another with their inner end areas 72*a* and 72*b* as well as 74*a* and 74*b*. The pieces of pipe 48*a* and 48*b* as well as 68*a* and 68*b* are, therefore, connected to one another in the area of their inner ends 72*a* and *b* as well as 74*a* and *b* and so the pieces of pipe 48*a* and 48*b* as well as 68*a* and 68*b* keep the inlet baffle 42 and the outlet baffle 44 positioned at a distance from one another.

Figure 4:
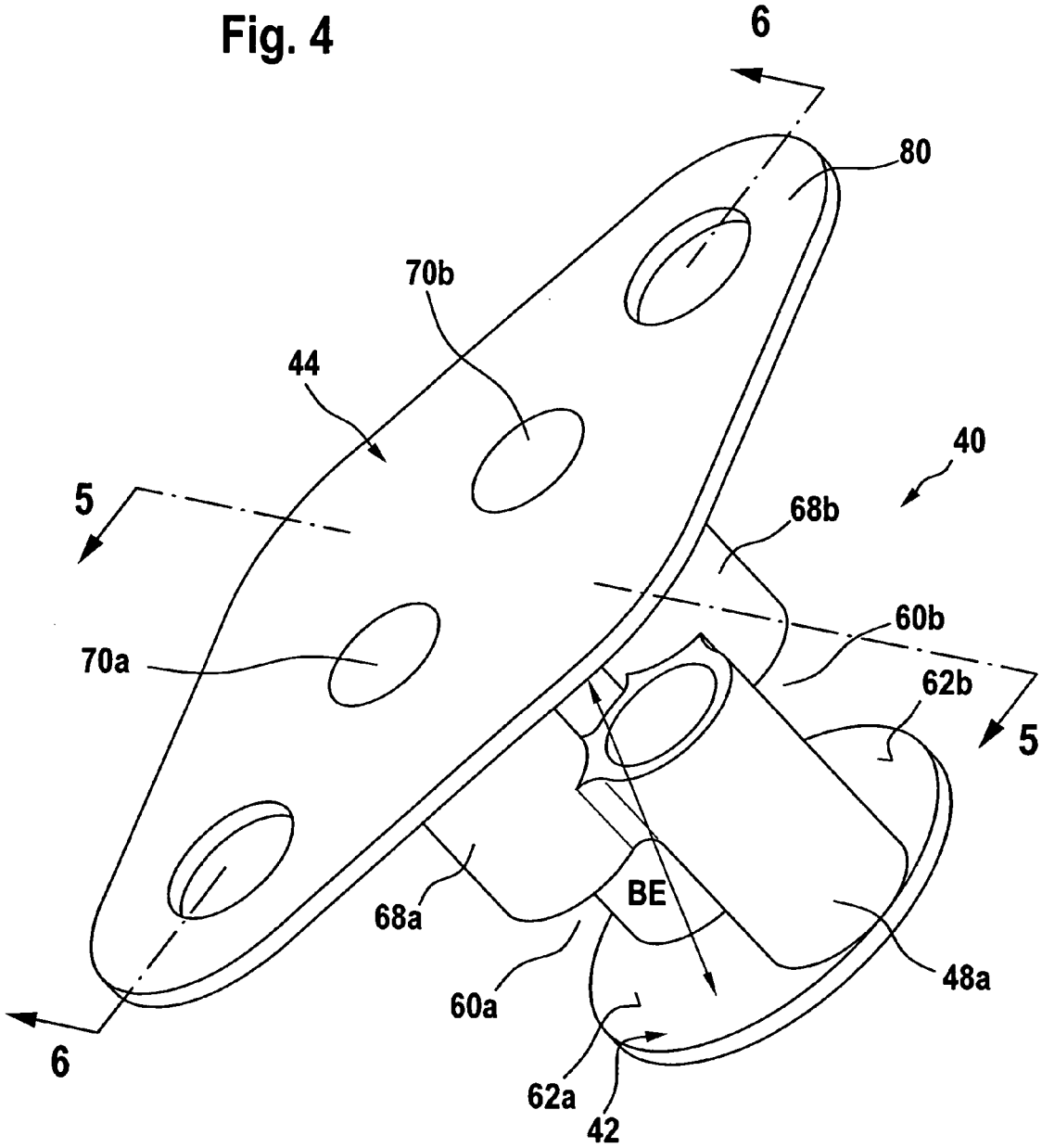
FIG. 4: shows a perspective illustration of a damping element according to the invention.
Figure 5:
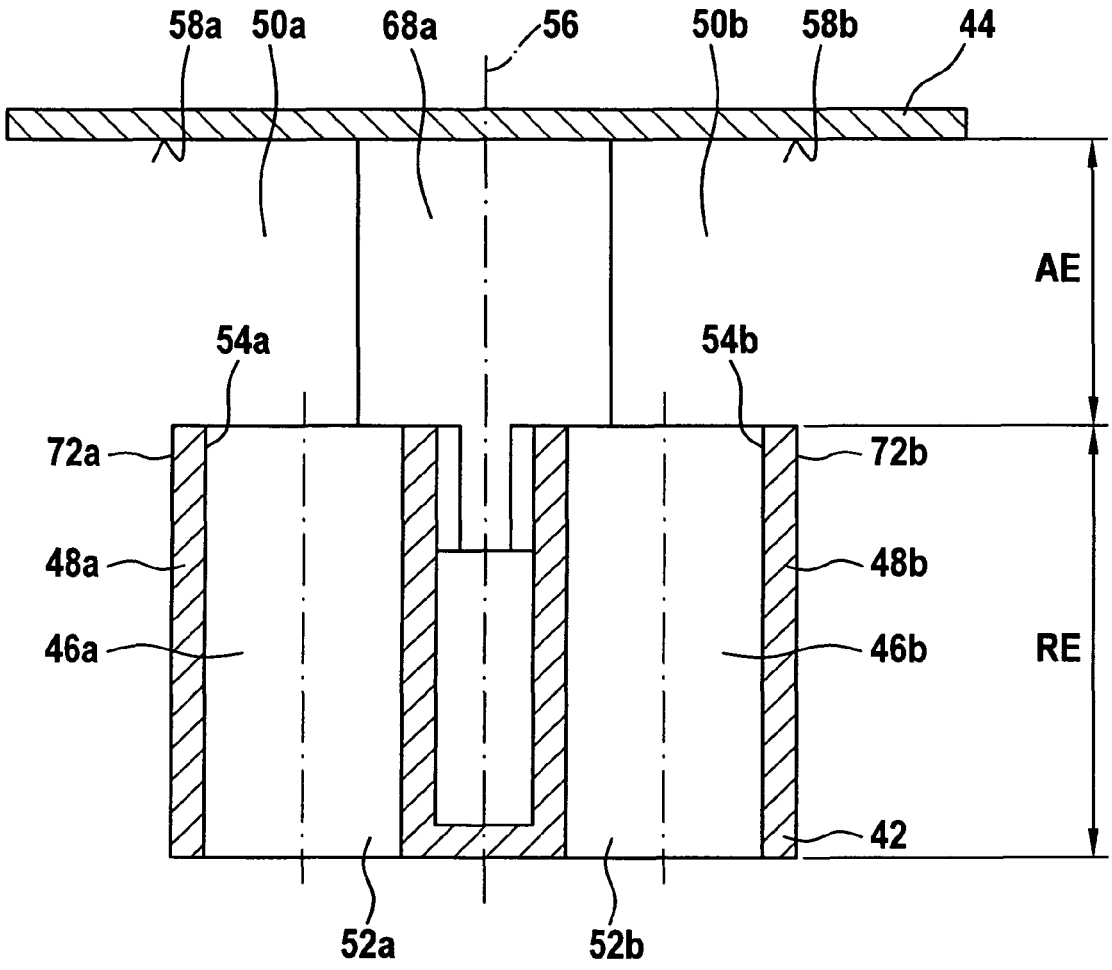
FIG. 5: shows a section along line 5-5 in FIG. 4.
Figure 6:
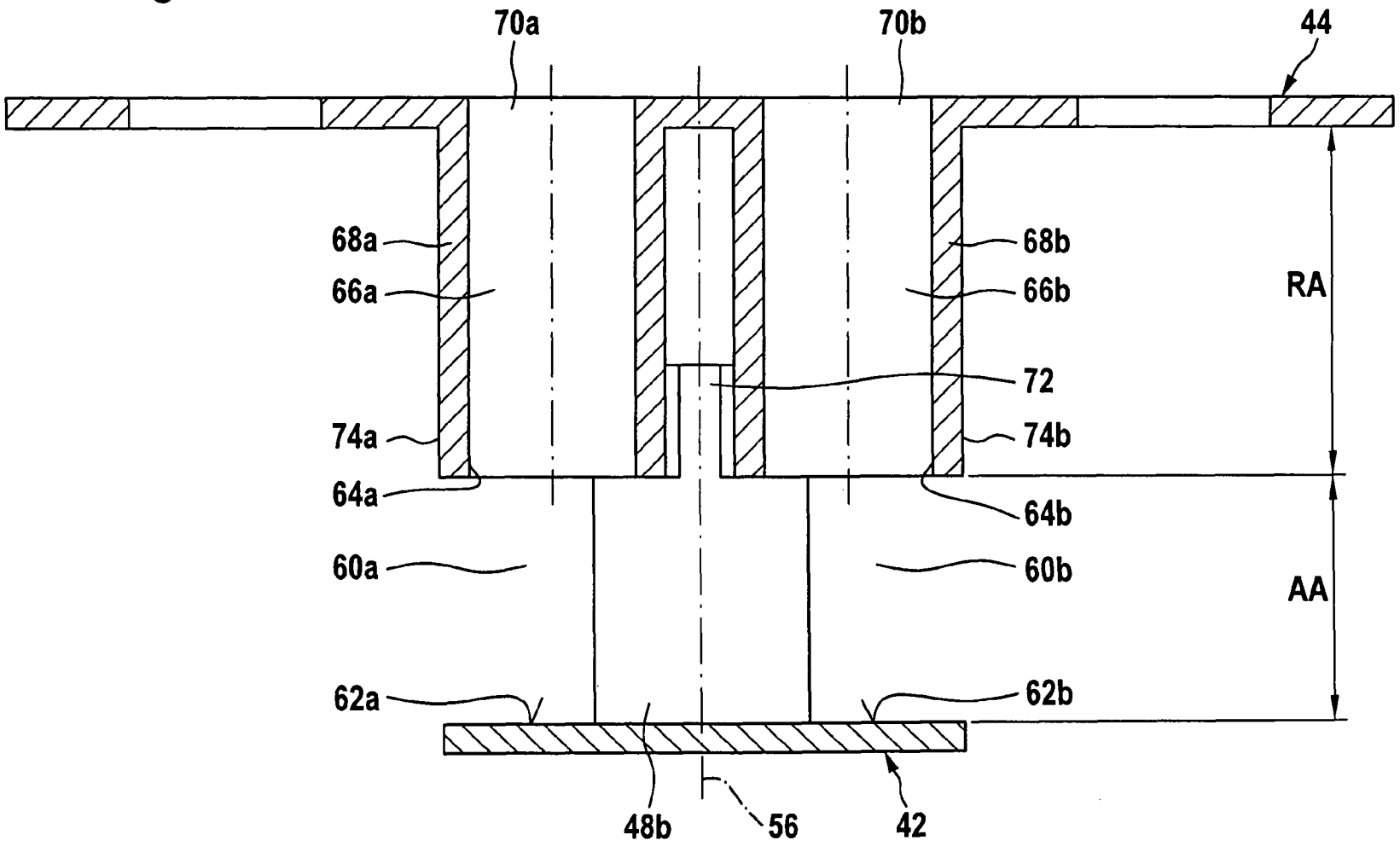
FIG. 6 shows a section along line 6-6 in FIG. 4.

Furthermore, the outlet baffle 44 of the solution according to the invention is, as illustrated, in particular, in FIGS. 1 and 4, provided with flange areas 80 so that the outlet baffle 44 can be placed on the connection surface 36 with a seal 82 located therebetween while the pipe connection 34 can be placed in a sealed manner on the flange area 80 with an additional seal 84 which is located on the side of the flange areas 80 located opposite the seal 82.

As a result, the damping element 40 according to the invention can be mounted in the outlet passage 32 in a simple manner, wherein the pieces of pipe 68*a* and 68*b* as well as 48*a* and 48*b* extend into the outlet passage 32 proceeding from the outlet baffle 44, which is connected in one piece to the flange area 80, and, therefore, hold the inlet baffle 42 in position in the outlet passage 32 in a defined manner. The inlet baffle 42 has such a diameter that it extends essentially over the cross section of the outlet passage 32 and so compressed refrigerant can enter the damping element 40 only via the entry openings 52.

The damping element 40 according to the present invention acts in a pulsation damping manner, as a result, since pulsation waves, which normally occur at frequencies which correspond to higher harmonics of the basic frequency, are damped in it by way of reflection.

The prerequisite for stationary waves which extinguish one another in the pieces of pipe 48*a* and 48*b* is that the length RE of the pieces of pipe 48*a* and 48*b* must correspond to half the wavelength $\lambda/2$ of a harmonic of the basic frequency since reflections occur each time at open ends as a result of the entry openings 52*a* and 52*b* as well as the inner openings 54*a* and 54*b*.

The prerequisite for stationary waves which extinguish one another between the inner openings 54*a* and 54*b* and the reflection surfaces 58*a* and 58*b* is that the length AE must correspond to a quarter wavelength $\lambda/4$ of a higher harmonic of the basic frequency since reflections occur at the open end as a result of the inner openings 54*a* and 54 and reflections occur at the closed end as a result of the reflection surfaces 58*a* and 58*b*.

The prerequisite for stationary waves which extinguish one another between the reflection surfaces 58*a* and 58*b* as well as 62*a* and 62*b* is that the distance BE must correspond to half the wavelength $\lambda/2$ of the higher harmonic of the basic frequency since a reflection is present between closed ends.

Finally, the prerequisite $AA=\lambda/4$ of the higher harmonic of the basic frequency results for stationary waves which extinguish one another from the distances AA between the reflection surfaces 62*a* and 62*b* as well as the inner ends 64*a* and 64*b*.

In addition, stationary waves which extinguish one another also occur when $RA=\lambda/2$ of the higher harmonic of the basic frequency.

Consequently, the damping element 40 is in a position to dampen a number of higher harmonics of the basic frequency, wherein the distances RE, BE and RA are selected such that their double value corresponds to one of the lowest harmonics of the basic frequency which occurs during the pulsations and wherein the distances AE and AA are selected such that their quadruple value corresponds to one of the lowest harmonics of the basic frequency, at which the pulsations occur.

In addition, the outlet chamber 24, on the one hand, and the subsequent pipe 34, on the other hand, also act as a chamber for the pulsation damping and so the damping element 40 itself does not require any chamber with a large volume and, therefore, allows a compact construction of the cylinder head 18, in which the damping element 40 can be integrated in a simple manner since it must, for its part, merely deflect and reflect pulsation waves.

In this respect, the volume of the outlet chamber 24 is preferably selected to be of such a size that this corresponds at least to double, even better at least triple a piston capacity per cylinder of the piston compressor in order to obtain as favorable a damping effect as possible.

The invention claimed is:

1. A refrigerant compressor comprising:

a compressor housing comprising:

a cylinder housing covered by a valve carrier, and an outlet chamber arranged adjacent said valve carrier and enclosed by a cylinder head, and an outlet passage in the cylinder head leading from the outlet chamber to an external high pressure connection;

a pulsation damping element at least partially inserted into the outlet passage in the cylinder head following the outlet chamber, the pulsation damping element having an inlet baffle facing the outlet chamber and extending over a cross section of the outlet passage in the cylinder head, and located opposite to the inlet baffle is an outlet baffle extending over the cross section of the outlet passage in the cylinder head; and at least one reflection chamber provided between the inlet baffle and the outlet baffle, the inlet baffle having at least one inlet baffle passage facing an outlet baffle reflection surface, and the outlet baffle having at least one outlet baffle passage facing an inlet baffle reflection surface;

wherein the inlet baffle and outlet baffle of the pulsation damping element are connected such that the pulsation damping element can be inserted into the outlet passage in the cylinder head as a single unit.

2. Refrigerant compressor as defined in claim 1, wherein the pulsation damping element is designed such that stationary waves extinguishing one another at a higher harmonic of a basic frequency of the refrigerant compressor are formed in said pulsation damping element.

3. Refrigerant compressor as defined in claim 2, wherein several stationary waves extinguishing one another are formed in the pulsation damping element, said waves corresponding to different higher harmonics of the basic frequency.

4. Refrigerant compressor as defined in claim 2, wherein the length of the at least one inlet baffle passage and the length of the at least one outlet baffle passage each correspond to one half of the higher harmonic of a basic frequency of the refrigerant compressor.

5. Refrigerant compressor as defined in claim 2, wherein the distance between the at least one outlet baffle pass'age and the inlet baffle reflection surface corresponds to one quarter of the higher harmonic of a basic frequency of the refrigerant compressor, and wherein the distance between the at least one inlet baffle passage and the outlet baffle reflection surface corresponds to one quarter of the higher harmonic of a basic frequency of the refrigerant compressor.

6. Refrigerant compressor as defined in claim 2, wherein the distance between the inlet baffle reflection surface and the outlet baffle reflection surface corresponds to one half of the higher harmonic of a basic frequency of the refrigerant compressor.

7. Refrigerant compressor as defined in claim 1, wherein the at least one inlet baffle passage has an inlet baffle passage inner opening and the at least one outlet baffle passage has an outlet baffle passage inner opening, wherein a fluid flowing through the pulsation dampening element follows a path that has a change in cross section at the inlet baffle passage inner opening, as the fluid flows out of the at least one inlet baffle passage, and a second change in cross section at the outlet baffle passage inner opening, as the fluid flows into the at least one outlet baffle passage.

8. Refrigerant compressor as defined in claim 7, wherein the inlet baffle passage inner opening is arranged at a distance from the outlet baffle, and the outlet baffle passage inner opening is arranged at a distance from the inlet baffle.

9. Refrigerant compressor as defined in claim 8, wherein the inlet baffle passage inner opening is located closer to the outlet baffle than the inlet baffle, and the outlet baffle passage inner opening is located closer to the inlet baffle than the outlet baffle.

10. Refrigerant compressor as defined in claim 1, wherein the at least one inlet baffle passage has approximately the same flow cross section as the at least one outlet baffle passage.

11. Refrigerant compressor as defined in claim 1, wherein the inlet baffle has a plurality of inlet baffle passages.

12. Refrigerant compressor as defined in claim 11, wherein the plurality of inlet baffle passages are arranged around a central axis of the pulsation damping element.

13. Refrigerant compressor as defined in claim 12, wherein the plurality of inlet baffle passages are arranged around the central axis of the pulsation damping element in a rotationally symmetric manner.

14. Refrigerant compressor as defined in claim 1, wherein the outlet baffle has a plurality of outlet baffle passages.

15. Refrigerant compressor as defined in claim 14, wherein the plurality of outlet baffle passages are arranged around a central axis of the pulsation damping element.

16. Refrigerant compressor as defined in claim 15, wherein the plurality of outlet baffle passages are arranged around the central axis of the pulsation damping element in a rotationally symmetric manner.

17. Refrigerant compressor as defined in claim 1, wherein the pulsation damping element includes a plurality of inlet baffle passages, each inlet baffle passage having a flow cross-sectional area, and wherein a sum of the flow cross-sectional areas for the plurality of inlet baffle passages is greater than 25% of a flow cross-sectional area of the outlet passage in the cylinder head.

18. Refrigerant compressor as defined in claim 1, wherein the pulsation damping element includes a plurality of outlet baffle passages, each outlet baffle passage having a flow cross-sectional area, and wherein a sum of the flow cross-sectional areas for the plurality of outlet baffle passages is greater than 25% of a flow cross-sectional area of the outlet passage in the cylinder head.

19. Refrigerant compressor as defined in claim 1, wherein the outlet passage in the cylinder head follows the outlet chamber and ends at the external high pressure connection.

20. The refrigerant compressor of claim 1, wherein a plate, that includes the outlet baffle, is configured to be fastened to an exterior surface of the compressor housing.

21. The refrigerant compressor of claim 1, wherein the pulsation damping element is removably attached to the cylinder head.

22. A refrigerant compressor comprising:

a compressor housing comprising:

a cylinder housing covered by a valve carrier, and an outlet chamber arranged adjacent said valve carrier and enclosed by a cylinder head, and an outlet passage in the cylinder head following the outlet chamber and ending at an external high pressure connection of the cylinder head;

a pulsation damping element at least partially inserted into the outlet passage in the cylinder head following the outlet chamber, the pulsation damping element having an inlet baffle facing the outlet chamber and extending over a cross section of the outlet passage in the cylinder head, and located opposite to the inlet baffle is an outlet baffle extending over the cross section of the outlet passage in the cylinder head; and at least one reflection chamber provided between the inlet baffle and the outlet baffle, the inlet baffle having at least one inlet baffle passage facing an outlet baffle reflection surface, and the outlet baffle having at least one outlet baffle passage facing an inlet baffle reflection surface;

wherein the inlet baffle and outlet baffle of the pulsation damping element are connected such that the pulsation damping element can be inserted into the outlet passage in the cylinder head as a single unit.

23. Refrigerant compressor as defined in claim 22, wherein the pulsation damping element is adapted to be fixed in position via an outer mounting element.

24. Refrigerant compressor as defined in claim 23, wherein the outlet baffle is provided with a flanged area serving as the outer mounting element.

25. The refrigerant compressor of claim 22, wherein a plate, that includes the outlet baffle, is configured to be fastened to an exterior surface of the compressor housing.

26. The refrigerant compressor of claim 22, wherein the pulsation damping element is removably attached to the cylinder head.

27. A refrigerant compressor comprising:

a compressor housing comprising:

a cylinder housing covered by a valve carrier, and an outlet chamber arranged adjacent said valve carrier and enclosed by a cylinder head, and an outlet passage in the cylinder head leading from the outlet chamber to an external high pressure connection;

a pulsation damping element at least partially inserted into the outlet passage in the cylinder head following the outlet chamber, the pulsation damping element having an inlet baffle facing the outlet chamber and extending over a cross section of the outlet passage in the cylinder head, and located opposite to the inlet baffle is an outlet baffle extending over the cross section of the outlet passage in the cylinder head; and at least two reflection chambers provided between the inlet baffle and the outlet baffle, the inlet baffle having at least one inlet baffle passage facing an outlet baffle reflection surface, and the outlet baffle having at least one outlet baffle passage facing an inlet baffle reflection surface;

wherein the at least one inlet baffle passage is formed by a first pipe and the at least one outlet baffle passage is formed by a second pipe, the first and second pipes extending from their respective baffles to respective reflection chambers; wherein an inner end of the first pipe is arranged so as to overlap with an inner end of the second pipe; and wherein the first pipe and the second pipe are connected to one another at their respective inner ends.

* * * * *

UNITED STATES PATENT AND TRADEMARK OFFICE

CERTIFICATE OF CORRECTION

PATENT NO. : 8,317,489 B2
APPLICATION NO. : 11/435168
DATED : November 27, 2012
INVENTOR(S) : Holger Barth It is certified that error appears in the above-identified patent and that said Letters Patent is hereby corrected as shown below:

Col. 6, line 52 replace "pass'age" with "passage"

Signed and Sealed this
Fifth Day of February, 2013

Teresa Stanek Rea
*Acting Director of the United States Patent and Trademark Office*